US011369174B2

(12) United States Patent
Martin

(10) Patent No.: US 11,369,174 B2
(45) Date of Patent: Jun. 28, 2022

(54) TRAVEL CREAM CASE

(71) Applicant: Bodil Martin, St. Johns, FL (US)

(72) Inventor: Bodil Martin, St. Johns, FL (US)

( * ) Notice: Subject to any disclaimer, the term of this patent is extended or adjusted under 35 U.S.C. 154(b) by 0 days.

(21) Appl. No.: 15/929,840

(22) Filed: May 26, 2020

(65) Prior Publication Data

US 2022/0000238 A1 Jan. 6, 2022

Related U.S. Application Data

(60) Provisional application No. 62/852,598, filed on May 24, 2019.

(51) Int. Cl.

| | |
|---|---|
| ***B65D 69/00*** | (2006.01) |
| ***A45D 40/24*** | (2006.01) |
| ***A45C 13/02*** | (2006.01) |
| ***B65D 25/04*** | (2006.01) |
| ***B65D 43/16*** | (2006.01) |
| ***A45D 34/00*** | (2006.01) |
| ***A45C 11/00*** | (2006.01) |
| ***A45D 42/00*** | (2006.01) |

(52) U.S. Cl.

CPC ..... *A45C 13/02* (2013.01); *A45C 11/00* (2013.01); *A45D 34/00* (2013.01); *A45D 40/24* (2013.01); *A45D 42/00* (2013.01); *B65D 25/04* (2013.01); *B65D 43/165* (2013.01); *A45C 2011/007* (2013.01)

(58) Field of Classification Search

CPC ..... A45D 34/00; A45D 40/24; A45D 42/00; A45C 13/02; A45C 11/00; A45C 2011/007; B65D 25/04; B65D 43/164; B65D 43/165

USPC ..... 206/541, 553, 564, 581; 220/259.2, 315, 220/324, 326, 328, 512, 520, 522, 810, 220/836, 840; 132/315

See application file for complete search history.

(56) References Cited

U.S. PATENT DOCUMENTS

| | | | | |
|---|---|---|---|---|
| 3,258,017 | A | 6/1966 | Albert | |
| 4,821,751 | A * | 4/1989 | Chen | A45D 33/24 132/295 |
| 4,826,014 | A * | 5/1989 | Schefer | A45D 33/22 132/294 |
| 4,964,526 | A * | 10/1990 | Stephens | A45C 11/24 132/315 |
| 5,022,529 | A * | 6/1991 | Kang | A45D 40/22 206/581 |
| 6,189,698 | B1 | 2/2001 | Asser | |
| 6,772,899 | B2 * | 8/2004 | Delmon | A45D 40/221 132/295 |
| 7,942,293 | B2 | 5/2011 | Lawrence et al. | |
| 8,225,955 | B2 | 7/2012 | Moskow et al. | |
| 9,131,761 | B2 * | 9/2015 | Kalyanpur | A45D 40/22 |
| 9,289,042 | B2 | 3/2016 | Bellas et al. | |

(Continued)

*Primary Examiner* — Luan K Bui

(74) *Attorney, Agent, or Firm* — Mark Young, PA

(57) ABSTRACT

A travel cream case includes an oblong case with a latch securement. The case includes a base, a hinged lid with a latch, and a tray locked in the base. The tray includes molded compartments for holding several removable refillable containers, each in a corresponding recess. Each container includes a removable lid. The tray includes additional recesses, each for storing an applicator or utensil, such as a spatula. Hinge components extend from the lid, through cutouts in the tray into sockets in the base. The sockets limit the range of motion of the hinge components.

20 Claims, 17 Drawing Sheets

(56) References Cited

U.S. PATENT DOCUMENTS

| | | | | |
|---|---|---|---|---|
| 9,955,773 | B1 | 5/2018 | Tavella | |
| 2007/0029226 | A1* | 2/2007 | Yuhara | A45D 33/006 206/581 |
| 2011/0147399 | A1* | 6/2011 | Salciarini | A45C 13/005 220/810 |

* cited by examiner

TRAVEL CREAM CASE

RELATED APPLICATION

This application is a nonprovisional and claims the benefit of priority of U.S. provisional application No. 62/852,598, filed May 24, 2019, the entire contents of which are incorporated herein by this reference.

FIELD OF THE INVENTION

The present invention relates generally to the field of receptacles or packages and more specifically relates to a case for storing a plurality of receptacles and utensils.

BACKGROUND

When traveling, some individuals prefer to bring along their facial products, such as various moisturizers and cleansers. Packing these products in a carry-on bag is mostly prohibited unless individually packaged in small travel bottles. Transferring the product into these bottles can be time consuming and messy and the individual bottles often get lost within the luggage. Many facial products are packaged in glass containers, which can break in checked baggage or in bags packed in a car. An efficient solution is needed.

Many travelers carry small personal items with them in a travel case. The modern traveler can be expected to have packages containing clothing, toiletries, small possessions, trip necessities, and possibly souvenirs on the way back home. Travelers are allowed to carry a limited number of smaller bags with them in a transport which may contain valuables and items needed during the journey.

Various attempts have been made to solve problems found in special receptacles or packages art. Among these are found in: U.S. Pat. Nos. 3,258,017, 9,955,773, 9,289,042, 8,225,955, 7,942,293, and 6,189,698. This prior art is representative of cosmetic or toilet special receptacles or packages.

None of the above inventions and patents, taken either singly or in combination, is seen to describe the invention as claimed. Thus, a need exists for a reliable travel cream case, and to avoid the above-mentioned problems.

The invention is directed to overcoming one or more of the problems and solving one or more of the needs as set forth above.

The present disclosure teaches a case that advantageously fills the deficiencies with the prior art. The case is superior to others in that it effectively provides a base, a hinged lid configured to open for a mirror on the underside of the lid, and a mating tray locked to the base, with separate compartments designed for holding products in jars and for folding one or more utensils.

While not limited to use for cosmetics and personal cleaners, the present invention provides a compact travel case for storing and transporting multiple facial products, such as night cream, eye cream, cleanser, exfoliate, and more. This enables users to pack facial creams in their carry-on luggage without violating guidelines or worrying about broken containers. It offers a convenient and accessible method for storing small amounts of facial products when traveling or while on the go. This eliminates the need to pack full size bottles in suitcases or purses. The present invention allows users to bring all of their necessary products along when traveling without inconvenience.

SUMMARY OF THE INVENTION

To solve one or more of the problems set forth above, in an exemplary implementation of the invention, a case includes an oblong case with a latch securement. The case is made from a sturdy plastic. The case includes a body (i.e., a base), a hinged lid with a latch, and a tray held in the body. The tray holds several removable refillable containers, each in a corresponding recess. Each container includes a removable lid and contains a topical substance. The tray includes additional recesses, each for storing an applicator or utensil, such as a spatula.

An exemplary case for storing receptacles according to principles of the invention, includes a tray locked to a base, and a lid hingedly coupled to the base. The lid includes a front and a back, and a pair of hinge brackets extending downwardly from the back of the lid. The tray includes a front edge, a back edge, a top surface, a bottom surface and a pair of cutouts (e.g., rectangular cutouts) at the back edge. A pair of locking members extend downwardly from the bottom surface of the tray, with a locking member adjacent to each cutout. A plurality of compartments are formed in the tray. Each receptacle compartment includes an open end at the top surface and is sized to receive a receptacle, such as a jar with a removable cap. The tray also includes a utensil compartment configured to receive a tool or utensil. The base includes a front, a back, a right side, a left side and a bottom defining a base compartment. A pair of hinge sockets are provided at the back of the base. Each hinge bracket of the lid extends through a cutout in the tray into a hinge socket in the base. Each hinge socket includes a first side wall, a second side wall spaced apart from and opposite the first side wall and a front wall extending from the first side wall to the second side wall, and an open back. Each hinge socket also includes an engagement slot in the front wall of the bracket. Each hinge bracket includes a hinge pin, which is received in a pin channel in the hinge socket. Each hinge bracket pivots about the hinge channel, from a closed position to an open position. In the closed position, the lid covers the base. In the open position, the lid extends upwardly at an angle greater than 90 from the base. The hinge socket impedes pivoting motion of the hinge bracket beyond the open position. Each locking member of the tray engages one of the sockets of the pair of sockets. Thus, the tray is locked to the base and disposed between the lid and the base. The tray includes a lug, as a locator, extending from the bottom surface of the tray adjacent to the front edge of the tray. The lug is a structure with an L-shaped profile. The base includes a ledge extending from the front of the base. The lug engages the ledge, with the ledge being received in a space defined by the lug. Each locking member is a cantilever hook. Each cantilever hook includes a beam and a retention feature. The beam extends from the bottom surface of the tray to the retention feature. The retention feature includes an angled insertion face. The retention feature engages the slot of the hinge socket. A mirror is attached to the underside of the lid.

BRIEF DESCRIPTION OF THE DRAWINGS

The foregoing and other aspects, objects, features and advantages of the invention will become better understood with reference to the following description, appended claims, and accompanying drawings, where:

Those skilled in the art will appreciate that the figures are not intended to be drawn to any particular scale; nor are the figures intended to illustrate every embodiment of the invention. The invention is not limited to the exemplary embodiments depicted in the figures or the specific components, configurations, shapes, relative sizes, ornamental aspects or proportions as shown in the figures.

DETAILED DESCRIPTION

The invention provides a case with a base, a lid, and a tray. The tray locks into the base and is disposed between the lid and the base. The tray includes compartments for secure storage of separate receptacles and utensils. The lid is connected to the base with hinges. The hinges allow a limited range of pivoting motion of the lid, from a closed position to an open position that provides a line of sight to a user.

Figure 1:
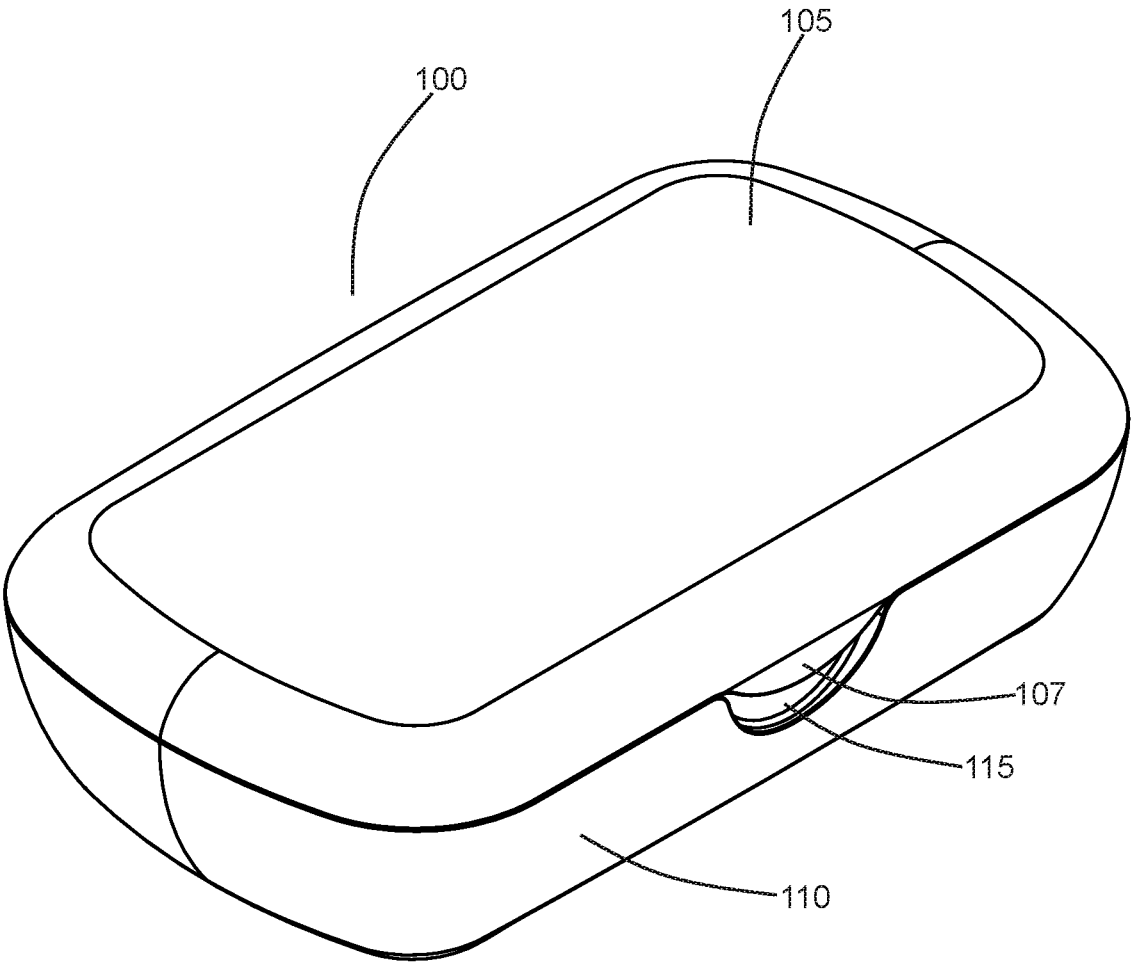
FIG. 1 is a perspective view of an exemplary case in a closed configuration according to principles of the invention.

With reference to FIG. 1, a perspective view of an exemplary case assembly 100 (i.e., a case) in a closed configuration is provided. The case includes a lid 105, a base 110, a tab 107, and a recess 115. The tab 107 extends from a leading edge of the lid 105. The recess 115 is a U-shaped cavity in the leading edge of the base 110. The tab 107 extends into the recess 115.

Figure 2:
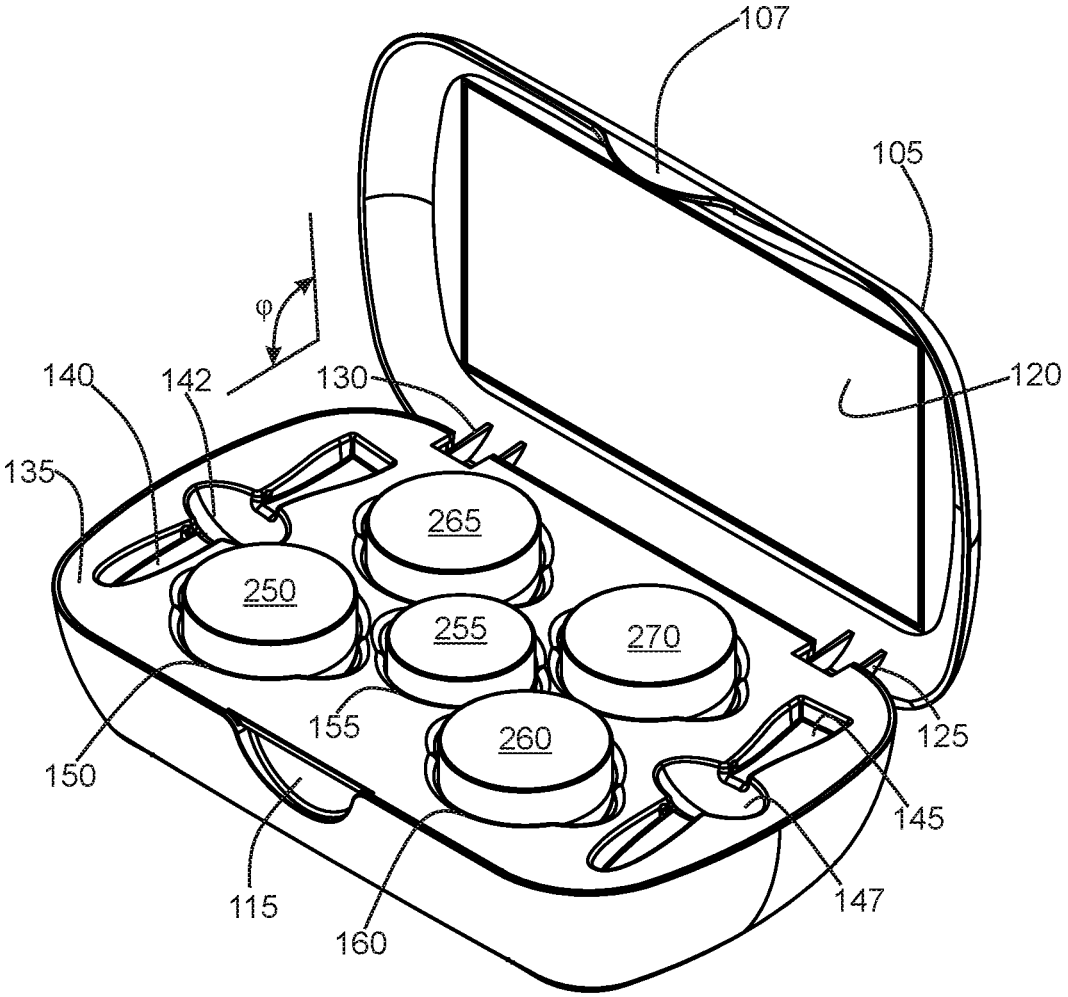
FIG. 2 is a perspective view illustrating the exemplary case in an open configuration revealing contained receptacles and utensils according to principles of the invention.

In FIG. 2, the exemplary case is shown in an open configuration, revealing the tray 135, contained receptacles 250-270 and utensil compartments 140, 145 according to principles of the invention.

Figure 5:
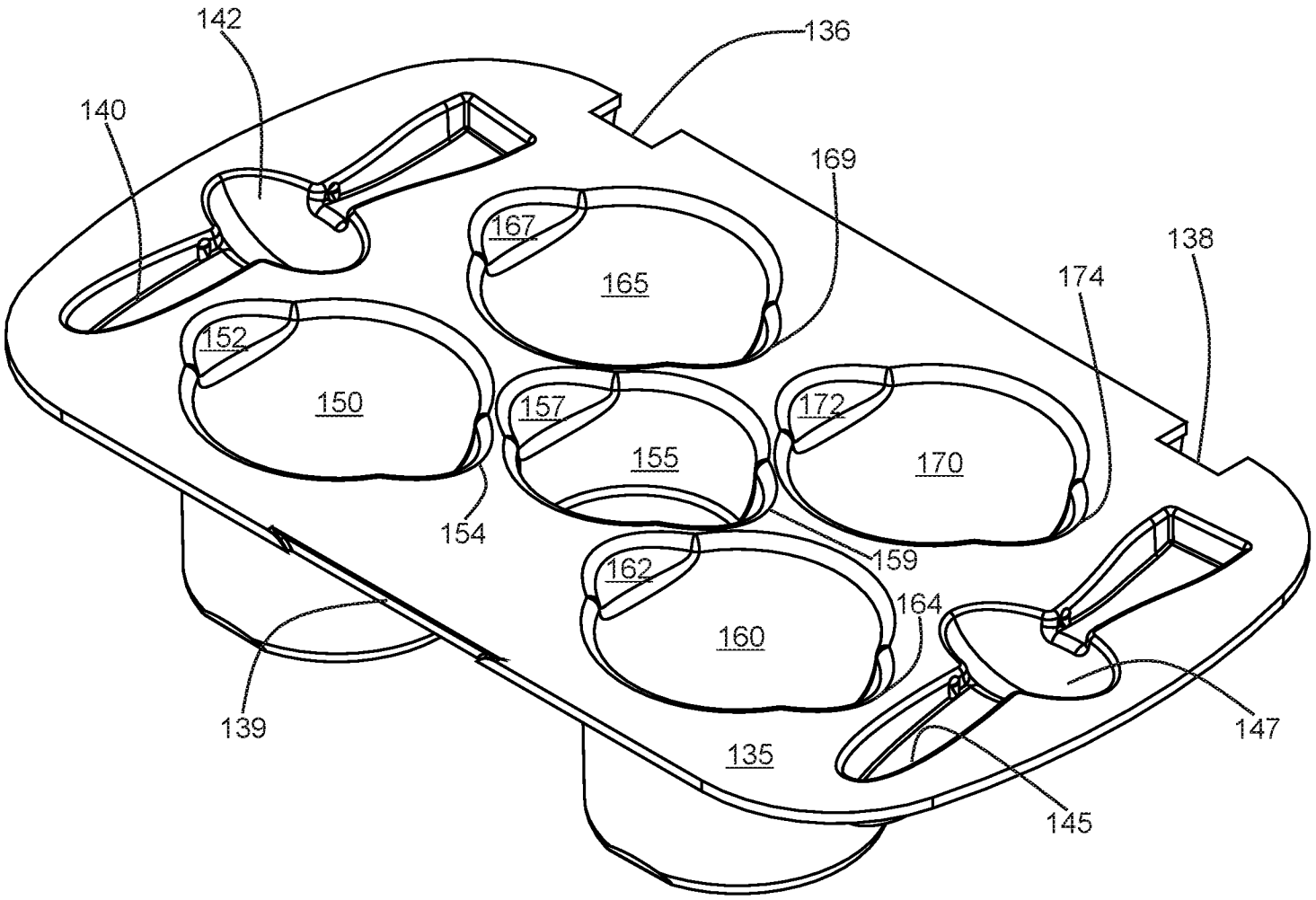
FIG. 5 is a top perspective view an exemplary receptacle tray for the case according to principles of the invention.
Figure 6:
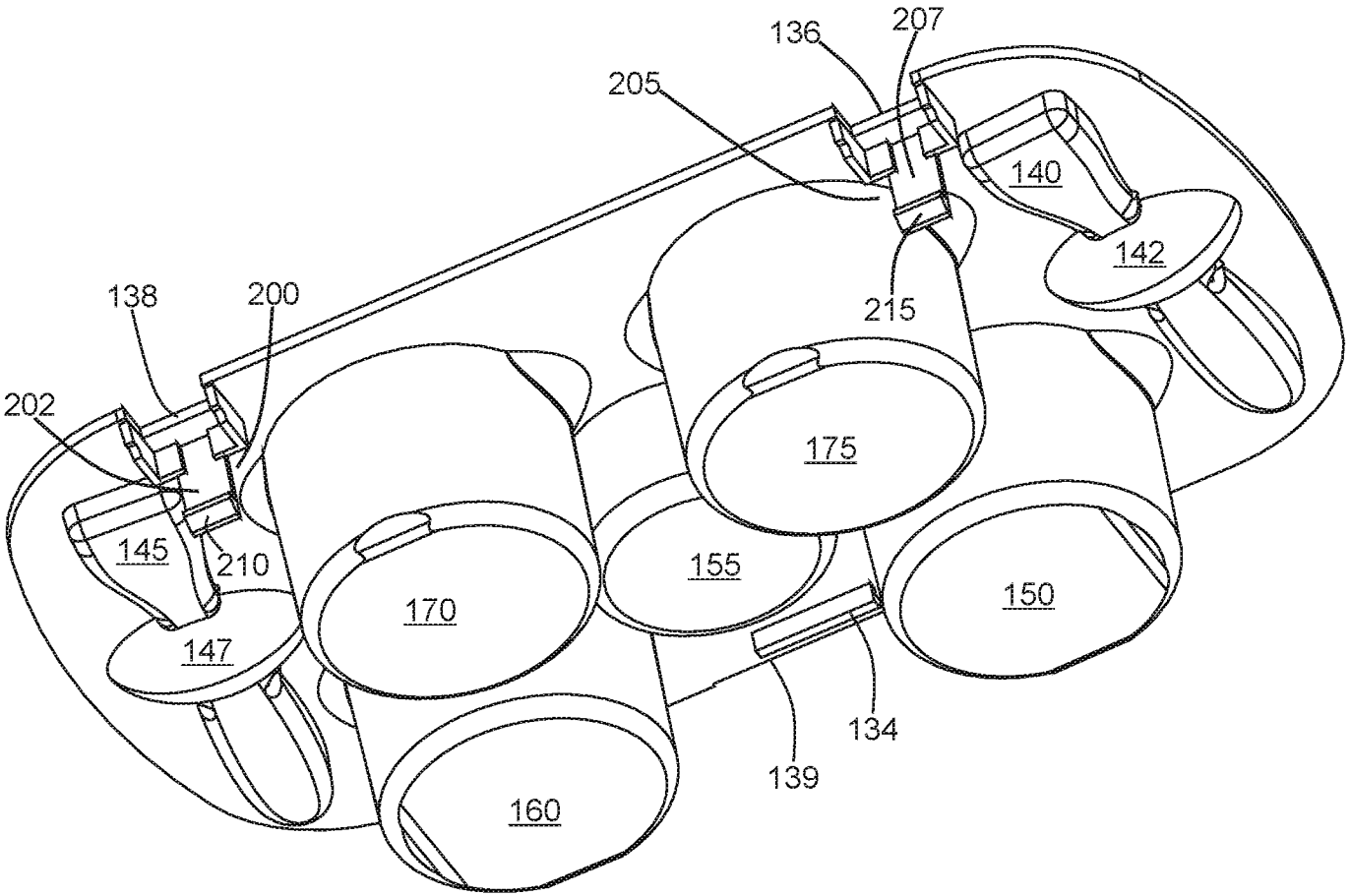
FIG. 6 is a bottom perspective view an exemplary receptacle tray for the case according to principles of the invention.

Each receptacle 250-270 is received in a compartment 150-170 (FIG. 3) formed in the tray 135. FIGS. 5 and 6 provide perspective views an exemplary receptacle tray 135 for the case according to principles of the invention. The exemplary tray 135 includes receptacle compartments 150-170 and utensil compartments 140, 145. Each compartment 140, 145 and 150-170 includes one or more finger recesses 142 for compartment 140; 147 for compartment 145; 152, 154 for compartment 150; 157, 159, for compartment 155; 162, 164 for compartment 160; 167, 169 for compartment 165; 172, 174 for compartment 170. The finger recesses facilitate gripping the contents of the compartment for insertion into the compartment or for removal from the compartment.

Figure 9:
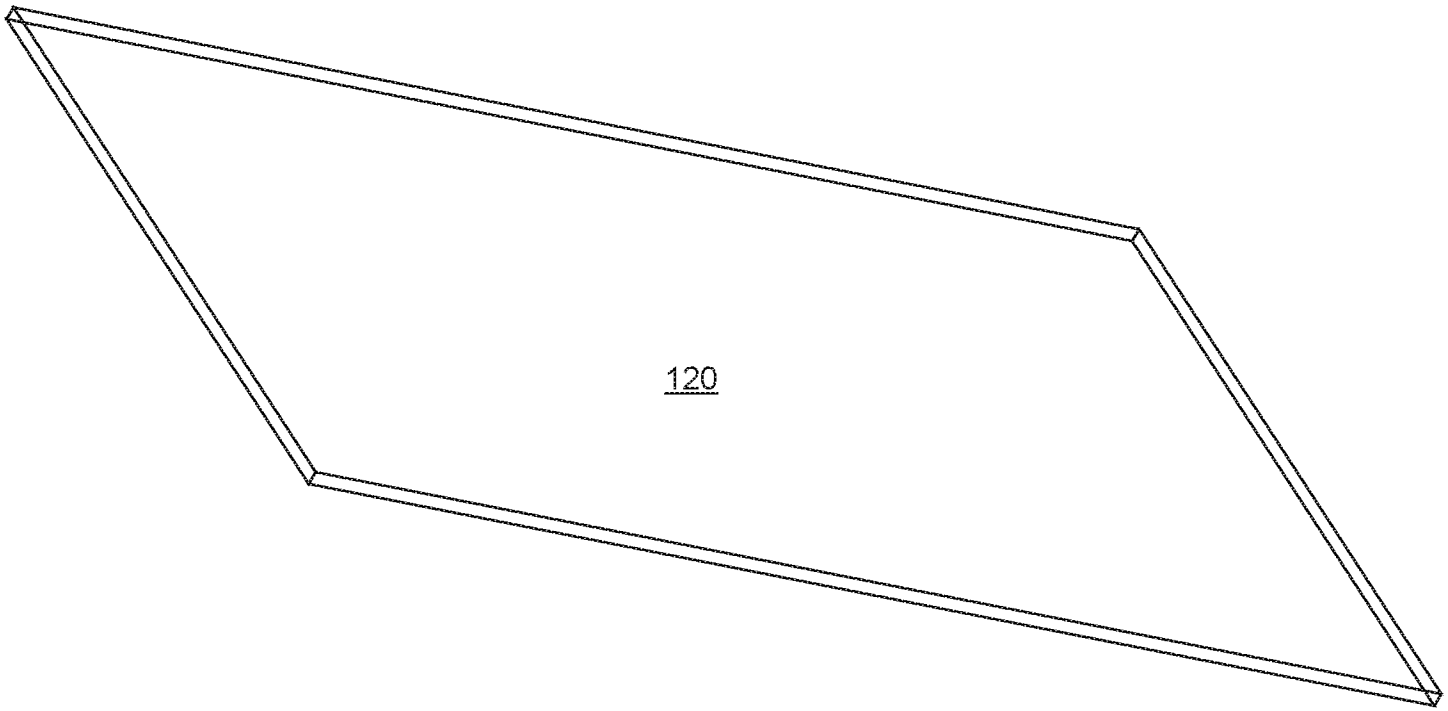
FIG. 9 is a perspective view of an exemplary mirror for the case according to principles of the invention.
Figure 10:
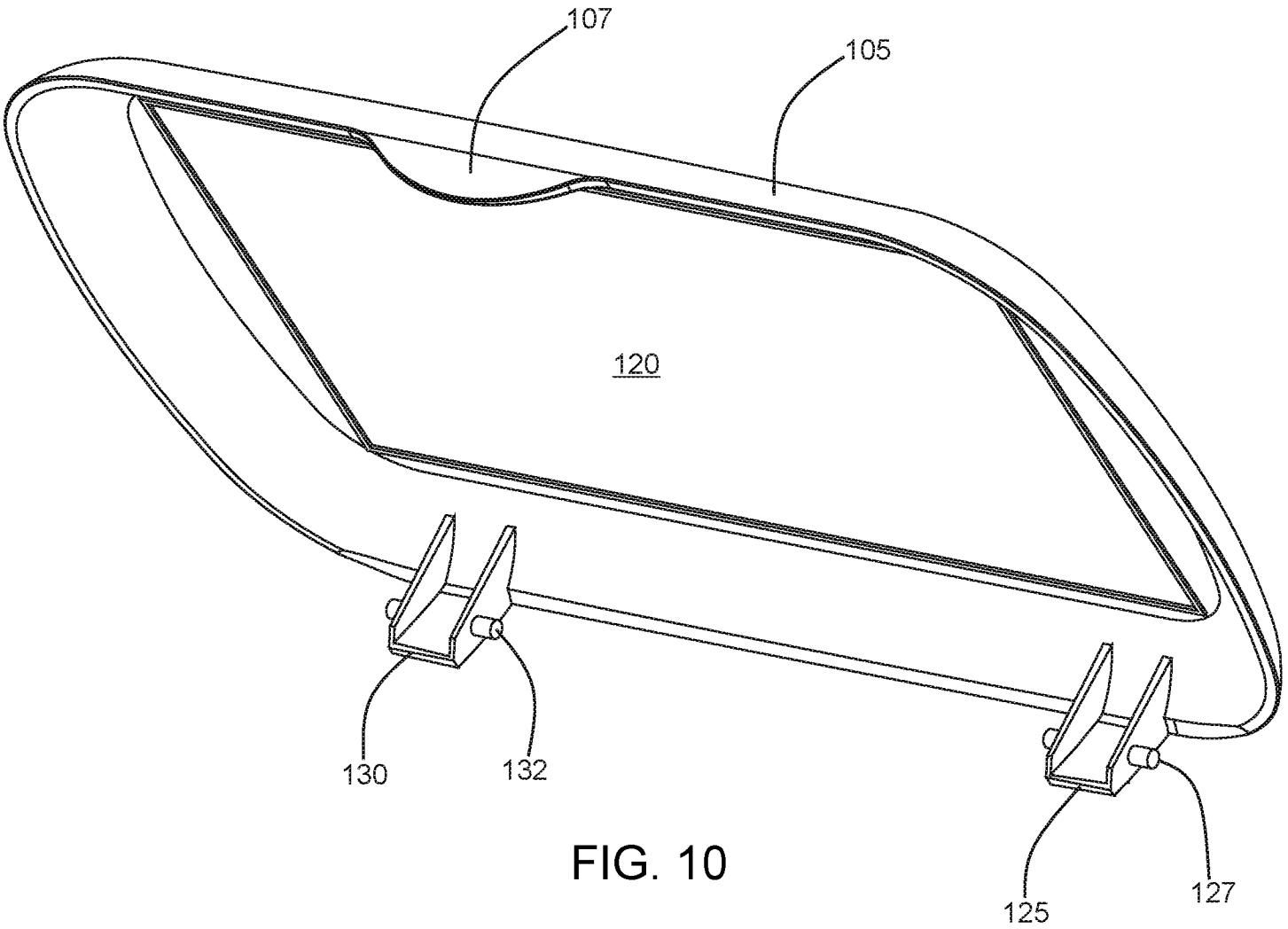
FIG. 10 is a perspective view of an exemplary lid for the case according to principles of the invention.

As also shown in FIGS. 9 and 10, a mirror 120 is attached to the underside of the lid 105 in the exemplary embodiment. The mirror may be permanently removably attached to the underside. In the case of removable attachment, magnets, snaps, or hook and loop fasteners may be used. In the open position, the lid 105 aims the mirror along a line of sight that diverges from the tray 135. Such a line of sight is useful as it allows a user to view her reflection in the mirror. The hinge assembly, as described below, which includes hinge brackets 125, 130, limits the range of pivoting motion of the lid to a fully open position that provides such a useful line of sight for the mirror.

Figure 3:
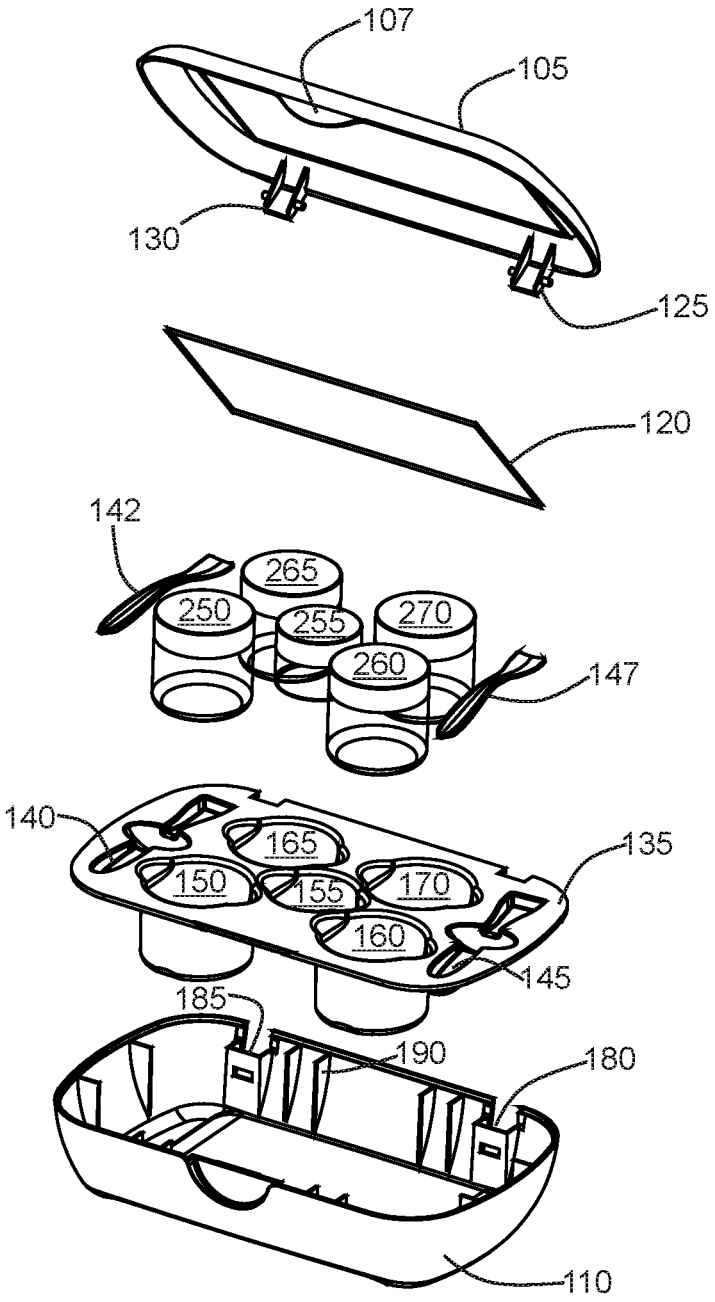
FIG. 3 is a perspective exploded view of the exemplary case according to principles of the invention.

FIG. 3 provides a perspective exploded view of the exemplary case 100 according to principles of the invention. As discussed in greater detail below, the tray 135 includes features for locking into the base 110. The lid 105 includes hinge brackets 125, 130 for mating with the hinge sockets 180, 185 in the base 110. The base also includes a plurality of spaced apart stiffening ribs 190.

Figure 4:
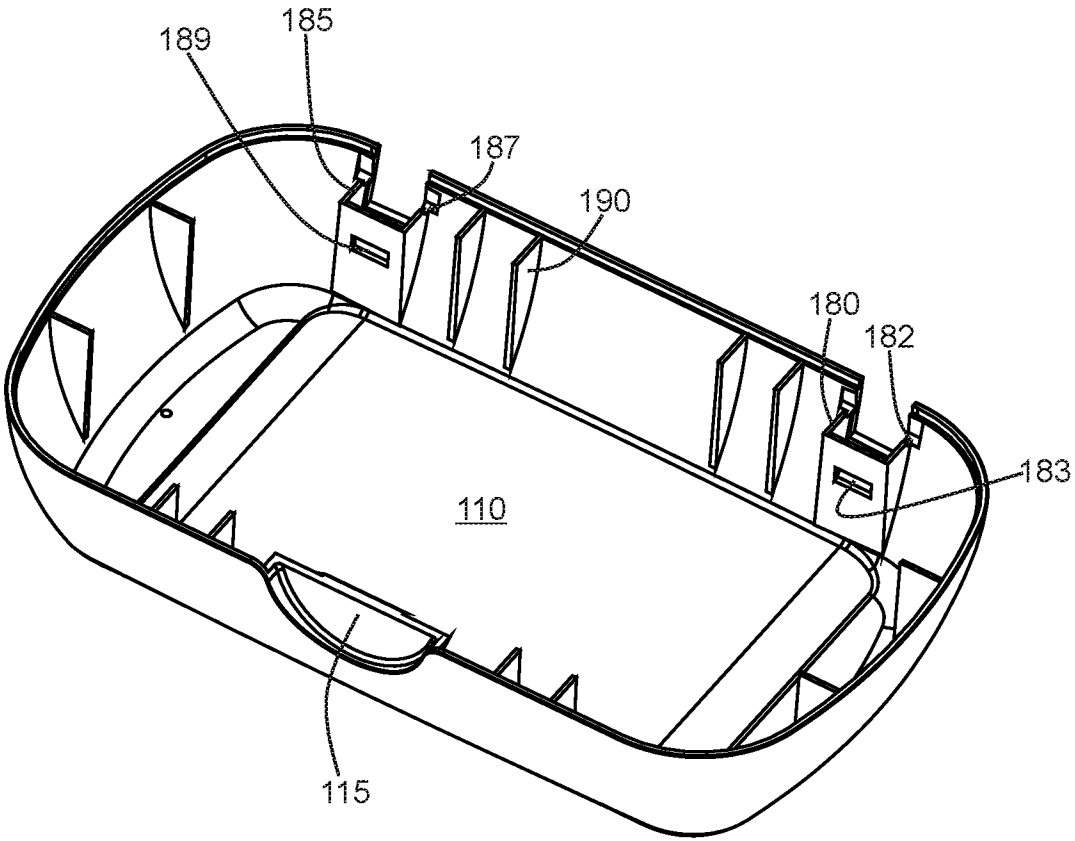
FIG. 4 is a perspective view a bottom portion of the exemplary case according to principles of the invention.
Figure 11:
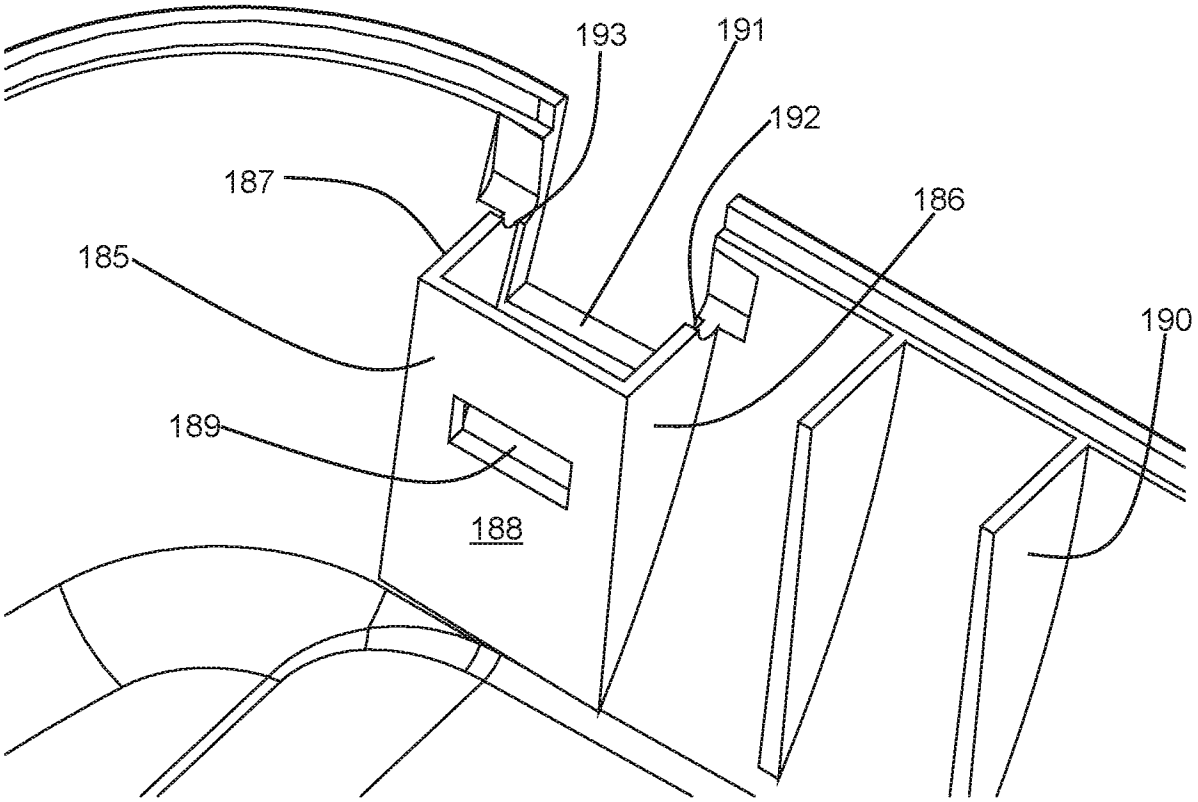
FIG. 11 is a perspective view of an exemplary portion of the base of the case according to principles of the invention.

With reference to FIGS. 4 and 11, each hinge socket 180, 185 includes side walls 186, 187, and a front wall 188 that define a socket cavity, 182. Each hinge socket 180, 185 receives a hinge bracket 125, 130. Each hinge bracket 125, 130 includes hinge pins 127, 132. The hinge pins 127, 132 plug into pin channels 192, 193 in the side walls 186, 187 of each hinge socket 180, 185. The pin channels 192, 193 are sized and shaped to provide a snap fit coupling with the hinge pins 127, 132, while allowing rotational motion of the pins 127, 132, relative to the hinge sockets 180, 185. A slot 183, 189 is provided in the front wall of each socket 180, 185. Each slot 183, 189, receives a portion of a retention feature 210, 215 of a cantilever hook 200, 205 (FIG. 6), when the tray 135 is installed on the base 110.

Figure 12:
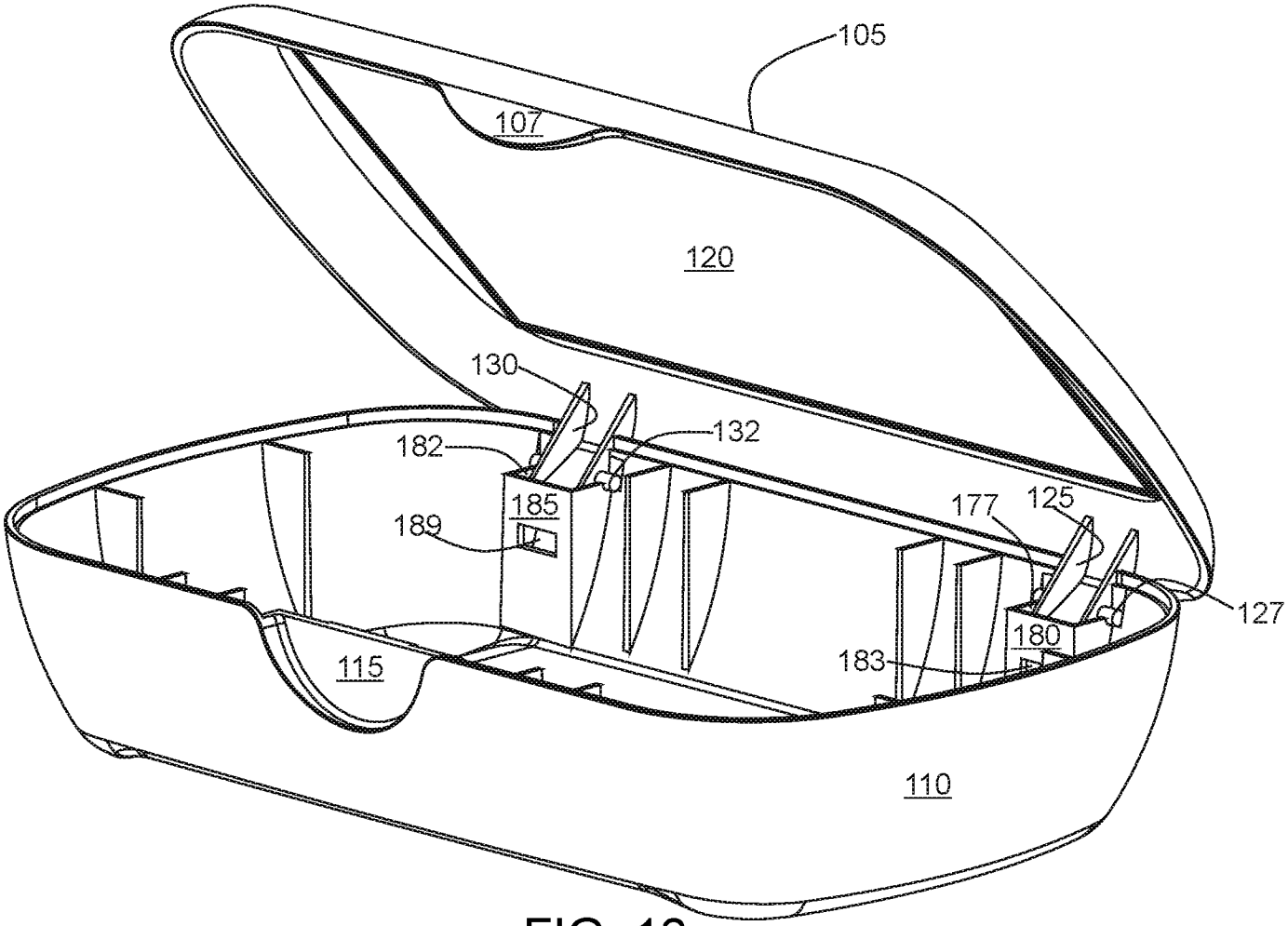
FIG. 12 is a perspective view of an exemplary assembled lid and base for the case according to principles of the invention.

With reference to FIGS. 10, 11 and 12, the hinge brackets 125, 130 mate with the hinge sockets 180, 185. The hinge sockets 180, 185 are open at the back. Side walls 186, 187 and front wall 188 define each hinge socket 180, 185. The hinge sockets 180, 185 are sized to allow a range of pivoting motion of the hinge brackets 125, 130, relative to the hinge sockets 180, 185. The range is from a closed position of the lid 105 to a fully open position of the lid 105. In the closed position, the lid 105 is oriented at an angle $\varphi$ relative to the base, where $\varphi$ equals 0°. In the fully open position, the lid 105 is oriented at an angle $\varphi$ (FIG. 2) relative to the base, where angle $\varphi$ is preferably 90° to 120°, more preferably greater than 90° and less than 120°, and even more preferably about 100° to 110°. When the lid 105 is in the fully open position, the hinge brackets 125, 130 abut the front wall 188 of each hinge socket 180, 185, thereby preventing pivoting beyond the fully open position.

With reference to FIG. 4, which provides a perspective view the base of the exemplary case according to principles of the invention, spaced apart parallel stiffening ribs 190 optionally extend from the interior wall of the base 110. The ribs 190 enhance structural integrity with reduced weight. The ribs are oriented to allow release from tooling (e.g., a mold) during the manufacturing process. Other structural enhancements, such as but not limited to, corrugations may be utilized without departing from the scope of the invention.

Figure 7:
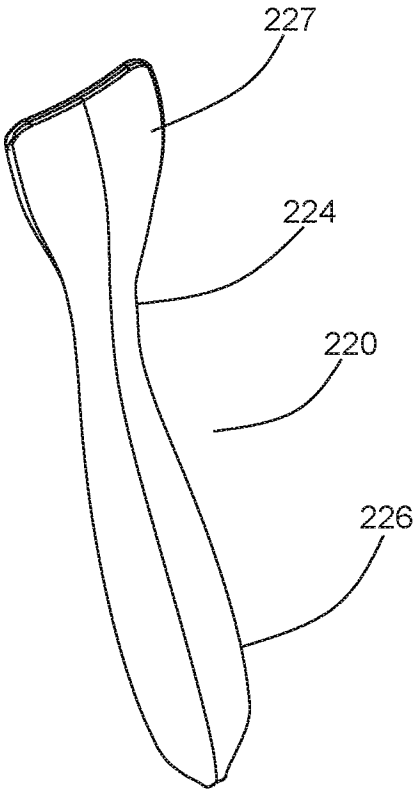
FIG. 7 is a perspective view of an exemplary utensil for the case according to principles of the invention.

FIG. 7 provides a perspective view of an exemplary utensil 220. The exemplary utensil 220 is a spatula, stirrer and spoon. The utensil 220 includes a handle 226 and head 227 joined by a neck 224. A portion of the utensil 220, such as the head 227, handle and/or neck 224 is held securely when stored in the utensil compartment 140, 145. While a particular utensil is illustrated, the invention is not limited to any particular utensil. Other utensils, such as brushes, droppers, pipettes, knives, spoons and other spatulas may be used in addition to or in lieu of the illustrated utensil. Additionally, the utensils are optional and may be omitted without departing from the scope of the invention.

Figure 8:
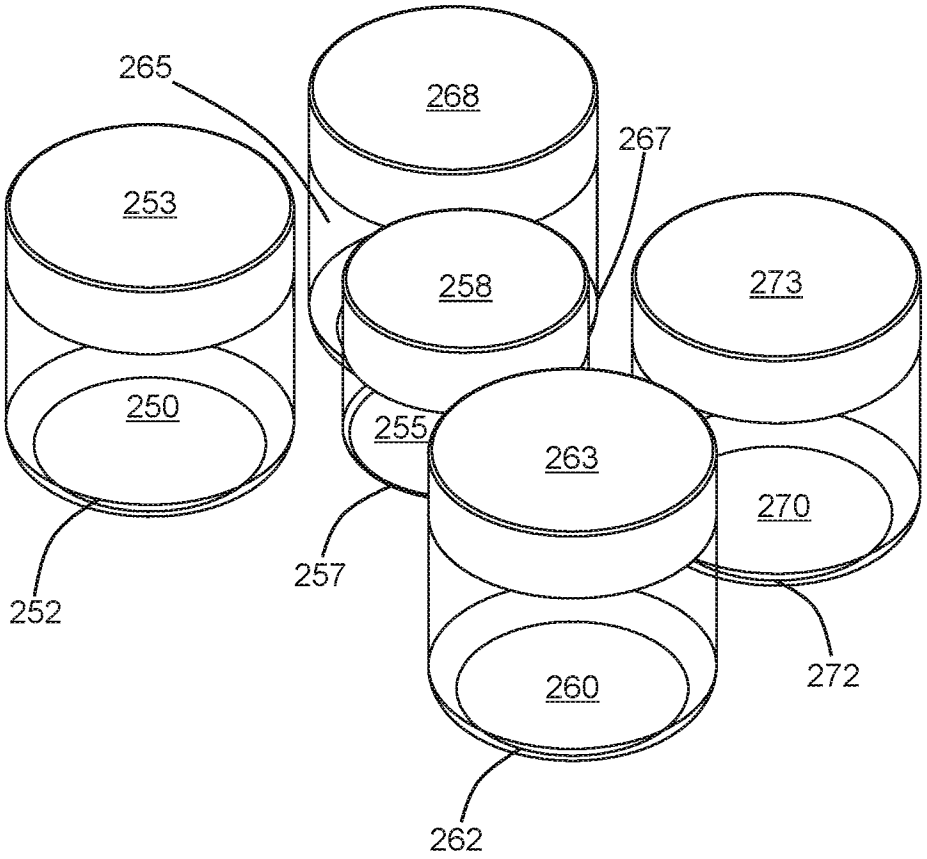
FIG. 8 is a perspective view of exemplary receptacles for the case according to principles of the invention.

FIG. 8 is a perspective view of exemplary receptacles 250-270. The exemplary receptacles 250, 255, 260, 265, 270 are transparent cylindrical jars 252, 257, 262, 267, 272, with removable lids 253, 258, 263, 268, 273. The invention is not limited to any particular size, shape, transparency, opacity or number of receptacles. The invention may be used with one or more receptacles that fit in one or more compartments in the tray 135, and do not interfere with closing of the lid 105.

With reference to FIG. 6, a pair of cantilever hooks 200, 205 extend downwardly from the bottom of the tray 135. The cantilever hooks 200, 205 extend downwardly adjacent to rectangular cutouts 136, 138 at the back (trailing) edge of the tray 135. The cutouts 136, 138 provide spaces for inserting the hinge brackets 125, 130 into hinge sockets 180, 185, below the tray 135.

Figure 15B:
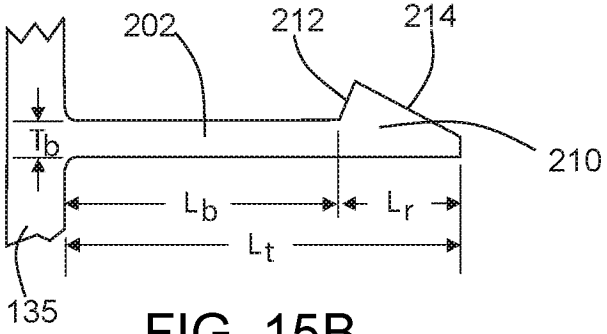
FIGS. 15A-C are schematics that conceptually illustrate properties of an exemplary cantilever hook for locking the tray to the base according to principles of the invention.
Figure 15A:
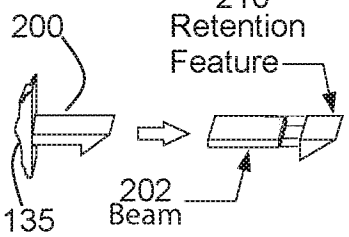
Figure 15C:
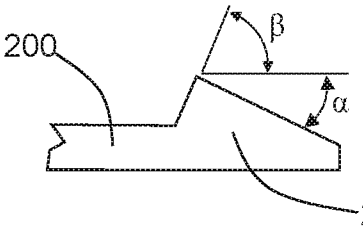

With reference to FIG. 6 and the closeups of FIGS. 15A-C, each cantilever hook 200, 205 includes a beam 202, 207 and a retention feature 210, 215. Each cantilever hook 200, 205 is sized and positioned for the beam portion 202, 207 of each cantilever hook 200, 205 to abut the front wall 188 (FIG. 11) of each hinge socket 180, 185, and for the retention feature 210, 215 of each cantilever hook 200, 205 to engage the slot 183, 189 in the front wall of each hinge socket 180, 185, when the tray 135 is locked to the base 110.

Additionally, with reference to FIGS. 15A-C, each cantilever hook 200, 205 may have certain geometric properties. The beam 202, 207 thickness at its base ($T_b$) should be about 50 to 60% of tray 135 thickness. Beams 202, 207 thinner than 50% may have filling and flow problems during molding. Beams 202, 207 thicker than 60% may have cooling problems at the base because of the thick section. This may, in turn, lead to high residual stresses and voids which will weaken the feature (at its point of highest stress).

The total cantilever hook 200, 205 length ($L_t$) is made up of beam length ($L_b$) and retention feature length ($L_r$). Beam 202, 207 length ($L_b$) should be at least five times beam thickness ($T_b$) but closer to ten times thickness is preferred. The beams 202, 207 can be longer than ten times thickness, but warpage and filling may become problems during molding. Beams 202, 207 shorter than five times beam thickness will experience significant shear effects as well as bending at the base. Shorter beams are much less flexible and create higher strains at the base. This increases likelihood of damage during assembly. Longer beams are more flexible for assembly and for release. As the subject invention does not require substantial retention force, length within the specified range, even at the higher end of the range, is not disadvantageous.

The retention feature 210, 215 includes an angled insertion face (at angle α, relative to the longitudinal axis of the beam) and an angled retention face (at angle β, relative to the longitudinal axis of the beam). The insertion face angle affects the assembly force. The steeper the angle, the higher the force required to deflect and engage the hook. Ideally, the insertion face angle should be great enough to adequately deflect the cantilever beam 200, 205 for locking insertion, but otherwise as low as possible for low assembly force. An angle of 20°-35° is preferred. Angles of a up to 45° or greater may be used, but make assembly difficult and should be avoided.

The retention face angle β will depend upon whether the lock is releasing or non-releasing and the magnitude of external separation loads. If the lock provided by the cantilever hooks 200, 205 is non-releasing, then the retention face angle β may be 80°-90°. If the lock provided by the cantilever hooks 200, 205 is releasing, but must withstand low external separation loads, then the retention face angle β may be from about 55°-79°. If the lock provided by the cantilever hooks 200, 205 is releasing, but is exposed to no external separation loads or low external separation loads, then the retention face angle β may be about 45°.

Figure 13:
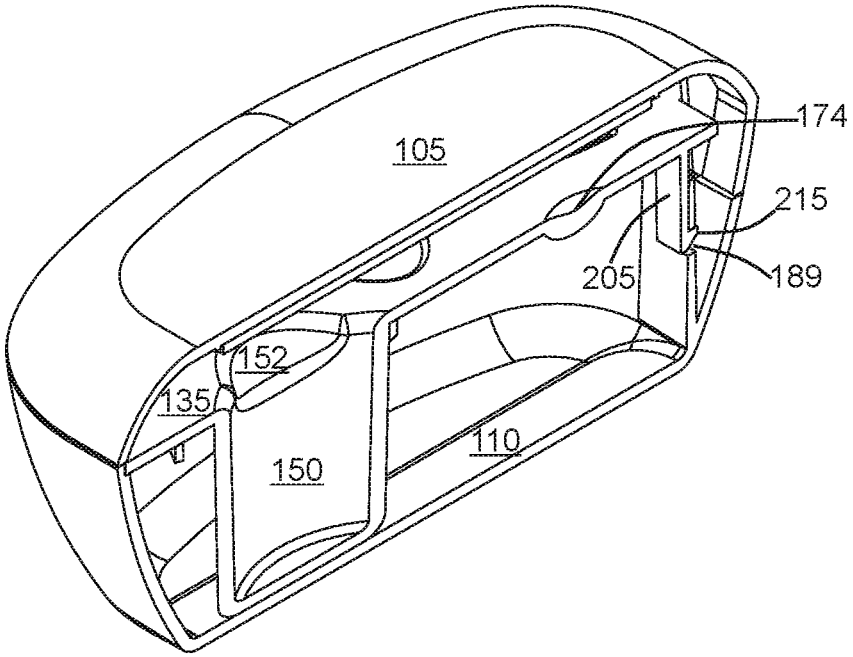
FIG. 13 is a perspective view of an exemplary section of the assembled lid, base and tray of the case according to principles of the invention.
Figure 14:
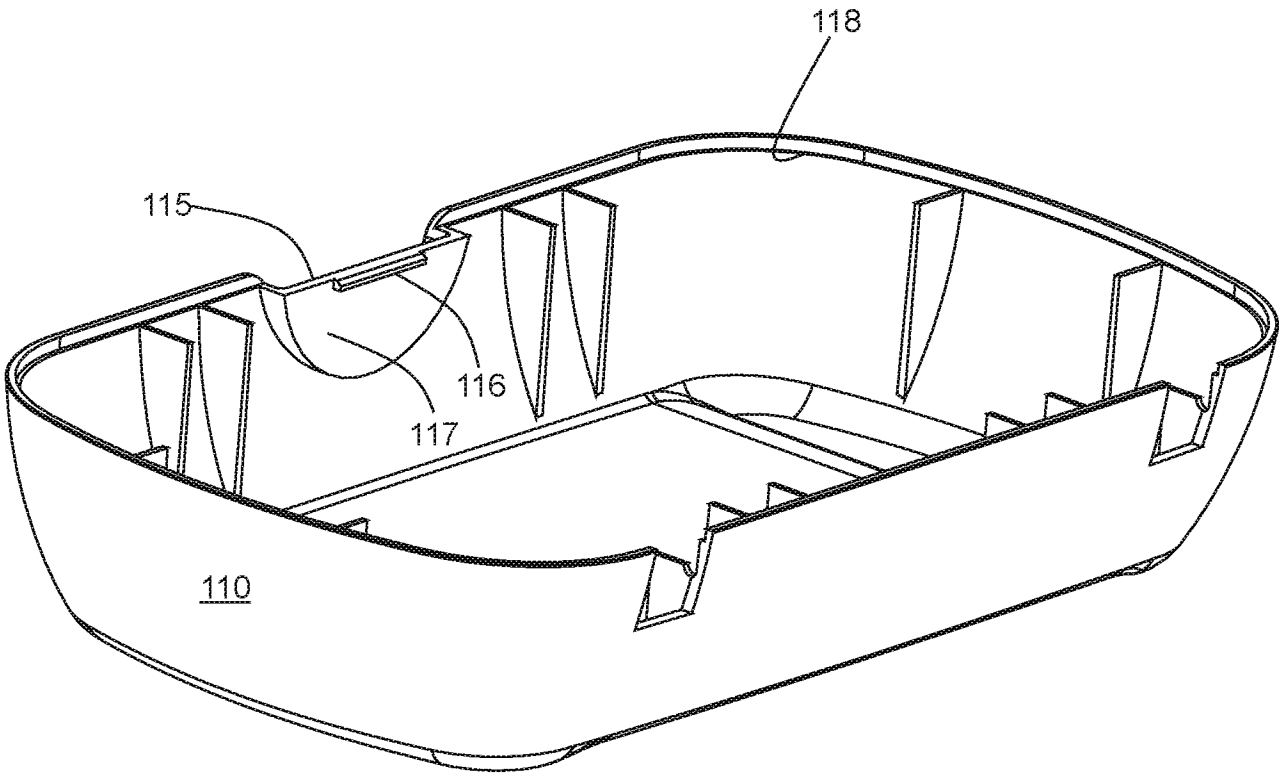
FIG. 14 is another perspective view of the exemplary base of the case according to principles of the invention.

Referring now to the section view of FIG. 13, the cantilever hook 205 is shown in the locked configuration. The retention feature 215 is partially received in the slot 189 in the front wall of the in the front wall of the hinge socket 185. The beam 207 (FIG. 6) is undeformed (i.e., not deflected) and abuts the front wall of the hinge socket.

Figure 16:
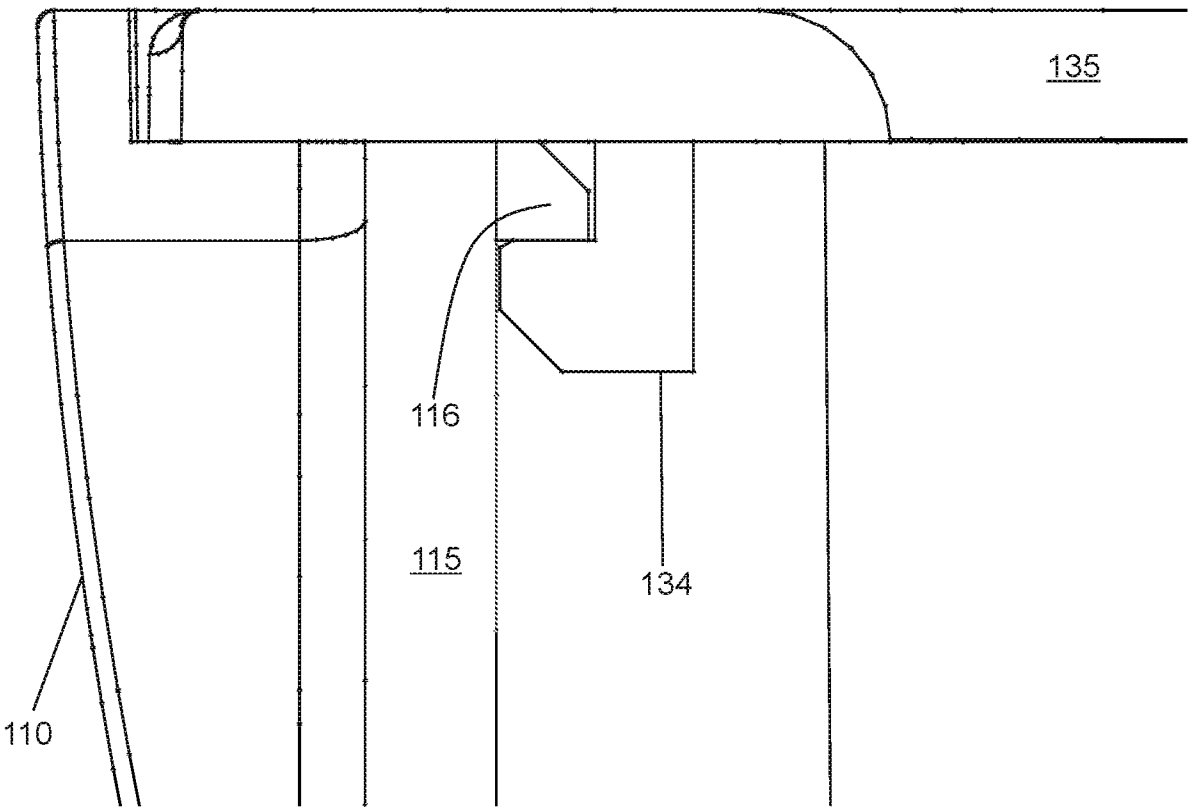
FIG. 16 is a section view of a portion of an assembled tray and base, illustrating a mating locator ledge and lug pair at the leading edge according to principles of the invention.

The leading (front) edge 139 of the tray 135 includes a locator, i.e. a lug 134 (FIGS. 6 and 16). The lug 134 mates with an element, i.e., ledge 116, projecting from the inner side of the front wall of the base 110. When mated, the lug 134 and ledge 116 pair holds the tray 135 in a position for locking. To lock the tray 135 to the base 110, the lug 134 is aligned with the ledge 116, while the cantilever hooks are pushed into engagement with the slots 183, 189 in the front walls of the hinge sockets 180, 185.

Figure 17A:
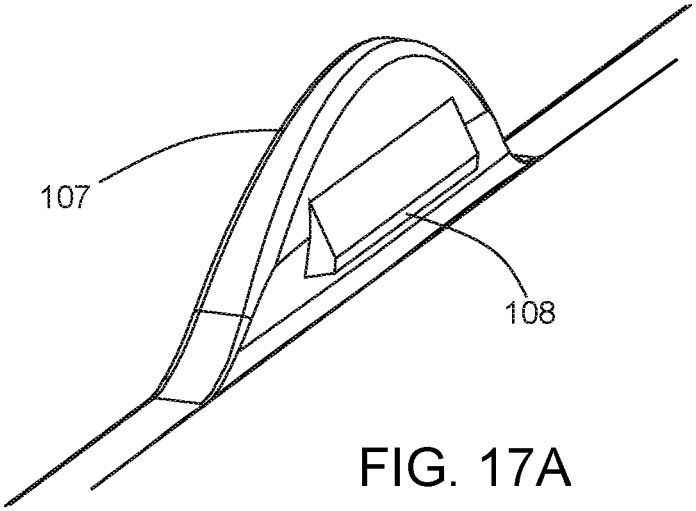
FIGS. 17A-B conceptually illustrate an exemplary latching mechanism for maintaining the lid in a closed position until it is released according to principles of the invention.
Figure 17B:
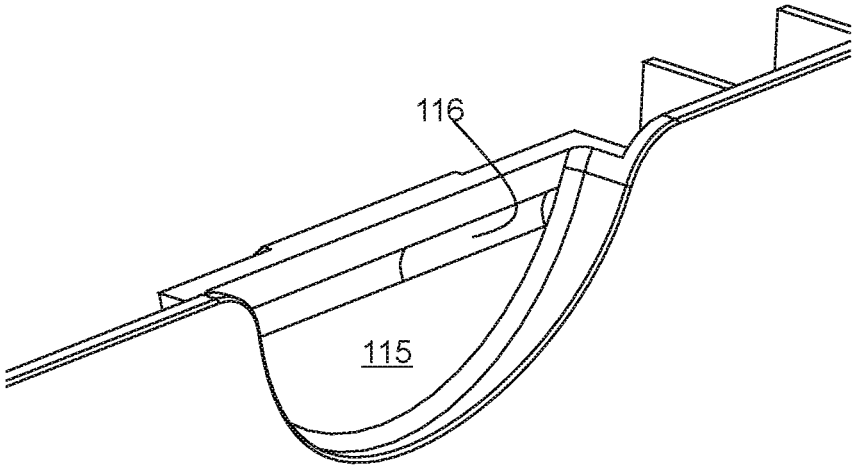

In FIGS. 17A and 17B, an exemplary latching mechanism is shown. The latching mechanism maintains the lid in a closed position until it is released. The latching mechanism includes a ledge 108 extending from the inner side of the tab 107 and a corresponding feature on the outer face of the recess 115. In the exemplary embodiment, the recess is a trough 116. However, a ledge may be used in lieu of a trough. In the exemplary embodiment, the ledge 108 mates with the trough 116, when the lid 105 is closed. If, instead of the trough 116, the recess included a ledge, the ledge of the recess would be positioned so that the ledge 108 of the tab resides immediately below the ledge of the recess 115 when the lid 105 is closed. Prying the tab 107 outwardly away from the recess releases 115 the ledge 108 from the trough 116 and allows the lid 105 to be lifted to an open position. In an alternative embodiment, the recess 115 may be equipped with a ledge and the tab 107 may be equipped with a trough.

A case 100 according to principles of the invention may be comprised of any of various plastics. In a non-limiting exemplary implementation, the case 100 is comprised of a polyvinyl chloride (PVC), nylon, polysulfone, polyethylene, polypropylene, polystyrene, acrylics, cellulosics, acrylonitrile-butadiene-styrene (ABS) terpolymers, urethanes, thermo-plastic resins, thermo-plastic elastomers (TPE), acetal resins, polyamides, polycarbonates and/or polyesters. Plasticizers or dispersants are may be incorporated in the plastic to improve flexibility of the material. Other suitable plastic compositions are known to those familiar with the art and may also be used in accordance with the present invention. Preferably the chosen material is relatively inexpensive, produces a durable and strong product, is easy to use in manufacturing operations and results in an aesthetically acceptable product.

The case 100 may optionally be formulated to change color when it reaches a predetermined or higher temperature. This can be accomplished by mixing a thermochromic additive (e.g., thermochromic pigment) to the base material in an amount that is sufficient to achieve a desired color changing range. As an example, a mixture of approximately 5% to 30% (pbw) of Matsui International Co., Inc.'s Chromicolor concentrate may be introduced to the base material, to provide a plastic structure that visibly changes color at a determined elevated temperature, such as approximately 90° Fahrenheit or higher. The elevated temperature may correspond to a temperature having functional significance to the stored contents. For example, the temperature may indicate a temperature above or below which the contents of the case should not be kept.

Alternatively, a photochromic additive may be added to the base material in an amount that is effective to achieve a desired color change when the case 100 is exposed to certain lighting conditions. As an example, a mixture of approximately 5% to 35% (pbw) of Matsui International Co., Inc.'s Photopia additive may be introduced to the base material, to provide a plastic structure that visibly changes color in the presence of sunlight or ultraviolet light.

As another alternative, phosphorescent polymer additives, such as aluminate based phosphors, may be added to adsorb light energy and continue to release that energy as visible light after the energy source is removed. Advantageously, such an embodiment provides a case 100 that is easy to locate in darkened conditions, making the device easy to spot even at nighttime.

The case 100 may be produced using any suitable manufacturing techniques known in the art for the chosen material, such as (for example) injection, compression, structural foam, blow, or transfer molding; polyurethane foam processing techniques; vacuum forming; and casting. Preferably, the manufacturing technique is suitable for mass production at relatively low cost per unit, and results in an aesthetically acceptable product with a consistent acceptable quality.

While an exemplary embodiment of the invention has been described, it should be apparent that modifications and variations thereto are possible, all of which fall within the true spirit and scope of the invention. With respect to the above description then, it is to be realized that the optimum relationships for the components and steps of the invention, including variations in order, form, content, function and manner of operation, are deemed readily apparent and obvious to one skilled in the art, and all equivalent relationships to those illustrated in the drawings and described in the specification are intended to be encompassed by the present invention. The above description and drawings are illustrative of modifications that can be made without departing from the present invention, the scope of which is to be limited only by the following claims. Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents are intended to fall within the scope of the invention as claimed.

What is claimed is:

1. A case for storing receptacles, the case comprising a lid including a front and a back, a pair of hinge brackets extending downwardly from the back of the lid;

a tray including a front edge, a back edge, a top surface, a bottom surface, a pair of cutouts at the back edge, a pair of locking members, each locking member of the pair of locking members extending downwardly from the bottom surface of the tray adjacent to each cutout, and a plurality of receptacle compartments, each of the plurality of receptacle compartments including an open end at the top surface, each receptacle compartment being sized to receive a receptacle;

a base including a front, a back, a right side, a left side and a bottom defining a base compartment; a pair of hinge sockets at the back of the base, each hinge bracket of the pair of hinge brackets of the lid extending through a cutout of the pair of cutouts into a hinge socket of the pair of hinge sockets in the base, and each locking member of the pair of locking members of the tray engaging one of the sockets of the pair of sockets; and the tray being locked to the base and being disposed between the lid and the base.

2. The case according to claim 1, each cutout of the pair of cutouts comprising a rectangular cutout.

3. The case according to claim 1, each hinge bracket of the pair of hinge brackets including a hinge pin.

4. The case according to claim 1, each hinge socket of the pair of hinge sockets including a pin channel.

5. The case according to claim 1, each hinge socket of the pair of hinge sockets including a first side wall, a second side wall spaced apart from and opposite the first side wall and a front wall extending from the first side wall to the second side wall, and an open back.

6. The case according to claim 1, each hinge socket of the pair of hinge sockets including an engagement slot.

7. The case according to claim 1, the tray further including a lug extending from the bottom surface of the tray adjacent to the front edge of the tray, the lug comprising an L-shaped structure; and the base further including a ledge extending from the front of the base, and the lug of the tray engaging the ledge of the base.

8. The case according to claim 1, each locking member of the pair of locking members comprising a cantilever hook, each cantilever hook comprising a beam and a retention feature, the beam extending from the bottom surface of the tray to the retention feature, and the retention feature including an angled insertion face, and the retention feature engaging one of the hinge sockets of the pair of hinge sockets.

9. The case according to claim 1, the lid further including an underside and a mirror attached to the underside of the lid.

10. The case according to claim 1, the tray further including a utensil compartment.

11. A case for storing receptacles, the case comprising a lid including a front and a back, a pair of hinge brackets extending downwardly from the back of the lid;

a tray including a front edge, a back edge, a top surface, a bottom surface, a pair of cutouts at the back edge, a pair of locking members, each locking member of the pair of locking members extending downwardly from the bottom surface of the tray adjacent to each cutout, and a plurality of receptacle compartments, each of the plurality of receptacle compartments including an open end at the top surface, each receptacle compartment being sized to receive a receptacle;

a base including a front, a back, a right side, a left side and a bottom defining a base compartment; a pair of hinge sockets at the back of the base, each hinge bracket of the pair of hinge brackets of the lid extending through a cutout of the pair of cutouts into a hinge socket of the pair of hinge sockets in the base, and each hinge bracket being pivotable from a closed position to an open position, and in the closed position, the lid covering the base, and in the open position, the lid extending upwardly from the base, and the hinge socket impeding pivoting motion of the hinge bracket beyond the open position, and each locking member of the pair of locking members of the tray engaging one of the hinge sockets of the pair of hinge sockets; and the tray being locked to the base and being disposed between the lid and the base.

12. The case according to claim 11, each cutout of the pair of cutouts comprising a rectangular cutout.

13. The case according to claim 12, each hinge bracket of the pair of hinge brackets including a hinge pin.

14. The case according to claim 13, each hinge socket of the pair of hinge sockets including a pin channel.

15. The case according to claim 14, each hinge socket of the pair of hinge sockets including a first side wall, a second side wall spaced apart from and opposite the first side wall and a front wall extending from the first side wall to the second side wall, and an open back.

16. The case according to claim 15, each hinge socket of the pair of hinge sockets including an engagement slot.

17. The case according to claim 16, the tray further including a lug extending from the bottom surface of the tray adjacent to the front edge of the tray, the lug comprising an L-shaped structure; and the base further including a ledge extending from the front of the base, and the lug of the tray engaging the ledge of the base.

18. The case according to claim 17, each locking member of the pair of locking members comprising a cantilever hook, each cantilever hook comprising a beam and a retention feature, the beam extending from the bottom surface of the tray to the retention feature, and the retention feature including an angled insertion face, and the retention feature engaging one of the hinge sockets of the pair of hinge sockets.

19. The case according to claim 18, the lid further including an underside and a mirror attached to the underside of the lid.

20. The case according to claim 19, the tray further including a utensil compartment.

* * * * *